US006363729B1

(12) United States Patent
Brahmbhatt et al.

(10) Patent No.: US 6,363,729 B1
(45) Date of Patent: Apr. 2, 2002

(54) APPARATUS AND METHOD FOR INJECTING CRYOGENIC LIQUID INTO CONTAINERS

(75) Inventors: Sudhir R. Brahmbhatt, Glencoe, MO (US); Gerald A. Dornblaser, Fallsington, PA (US)

(73) Assignee: MG Industries, Malvern, PA (US)

( * ) Notice: Subject to any disclaimer, the term of this patent is extended or adjusted under 35 U.S.C. 154(b) by 0 days.

(21) Appl. No.: 09/626,989

(22) Filed: Jul. 27, 2000

(51) Int. Cl.[7] ..... F25B 19/00
(52) U.S. Cl. ..... 62/51.1; 62/911
(58) Field of Search ..... 62/51.1, 911

(56) References Cited

U.S. PATENT DOCUMENTS 4,561,258 A 12/1985 Brodbeck et al.
4,578,963 A * 4/1986 Sitte ..... 62/51.1
4,592,205 A 6/1986 Brodbeck et al.
4,640,099 A * 2/1987 Gibot ..... 62/51.1
4,768,356 A * 9/1988 Volker ..... 62/51.1
5,385,025 A 1/1995 Kellett

* cited by examiner

*Primary Examiner*—Ronald Capossela
(74) *Attorney, Agent, or Firm*—William H. Eilberg

(57) ABSTRACT

A compact device for injecting cryogenic liquid into containers is capable of use with containers of varying sizes. A vessel containing the cryogenic liquid is connected to a nozzle by a thermally-insulated, flexible hose. The nozzle is connected to an arm which is mounted to a support, such that the arm can move in different directions relative to the support. The nozzle can thus be moved with three degrees of freedom, and can be easily positioned over a container to be filled. The apparatus also includes conduits for conveying excess gas from the vessel into a process controller housing, to keep moisture out of that housing. The nozzle includes ports which receive gas formed by vaporizing cryogenic liquid from a supply. Gas flowing into these ports can be used to control the formation of droplets. When heated, such gas can also be used to prevent ice formation in the nozzle, or to remove ice that has already formed. The device of the present invention will work easily with nozzles or nozzle orifices of varying sizes, and can be installed in relatively cramped surroundings.

55 Claims, 4 Drawing Sheets

APPARATUS AND METHOD FOR INJECTING CRYOGENIC LIQUID INTO CONTAINERS

BACKGROUND OF THE INVENTION

This invention relates to the field of cryogenic liquids. In particular, the invention provides an apparatus and method for adding droplets of a cryogenic liquid to cans or plastic bottles, such as beverage containers. However, the invention can be used in any other application requiring the controlled dispensing of droplets of a cryogenic liquid.

Beverage containers made of aluminum or plastic have the advantage of being light in weight and relatively low in cost. But the softness of these materials makes it impractical to stack aluminum or plastic containers, unless the containers are pressurized, as would be true for carbonated beverages. Thus, to overcome the problem for the case of non-carbonated beverages, it has been known to inject small amounts of a cryogenic liquid, usually liquid nitrogen, into the container, immediately before the container is sealed. The cryogenic liquid vaporizes almost instantly, and expands to many times its original volume. The vaporized cryogen provides the desired internal pressure for the container.

U.S. Pat. Nos. 4,561,258 and 4,592,205, the disclosures of which are incorporated by reference herein, both show systems intended to deliver steady streams of cryogenic liquids, such as liquid nitrogen, for the purposes described above. U.S. Pat. No. 5,385,025, the disclosure of which is also incorporated by reference herein, shows a device which dispenses discrete droplets of cryogenic liquid into a container.

One of the problems with the devices of the prior art is that it is difficult to adapt the droplet dispensing equipment for use with nozzles of different sizes. In a typical injector of the prior art, the nozzle is an integral part of the vessel which holds the cryogenic liquid before it is dispensed. The vessel storing the cryogenic liquid typically has a portion of narrowing diameter that comprises the injector nozzle. Because the injector is thus an integral part of the vessel, it can be very difficult or impossible to vary the size of the nozzle. If the the nozzle size can be varied, one can use the same apparatus to work with containers of different sizes.

Another problem with the devices of the prior art is that such devices are not compact. It is often difficult to adapt a given piece of equipment for use in a small space, or to work with a particular carousel which holds a plurality of containers.

The handling of cryogenic liquids inevitably involves heat losses; some liquid becomes vaporized and escapes without being used. Such losses decrease the overall efficiency of the system, and increase the cost of operation. It is therefore desirable to improve the efficiency of prior art devices, by reducing unwanted losses of gas, and by providing a use for the gas that does escape from the reservoir of cryogenic liquid.

Another problem encountered in the operation of a liquid nitrogen injector is the tendency to form moisture and/or to cause icing. Icing and condensation are likely to form where the air is moist and cold, and such conditions are likely to occur in the presence of vaporized liquid nitrogen. Moisture can find its way to the delicate circuitry in the process control unit, eventually leading to deterioration of that circuitry. Icing is especially problematic when it forms at or near the nozzle. Ice can render the nozzle inoperative, blocking all flow of cryogenic liquid. In such cases, it is necessary to interrupt production, and either to replace the nozzle or de-ice it. Ice can also break off from the nozzle, and/or from the nozzle jacket, and can fall into the containers, in which case the containers are considered contaminated and unsalable. It is therefore essential to prevent ice from forming anywhere near the containers.

The present invention provides an apparatus and method which addresses the problems discussed above, and which provides an economical and effective solution to the problem of injecting a cryogenic liquid into containers.

SUMMARY OF THE INVENTION

The apparatus of the present invention includes a vessel for storing a cryogenic liquid, which can be liquid nitrogen. A flexible, thermally-insulated hose connects the vessel to a nozzle. A vertically oriented support holds the vessel at a desired level above the ground, and an adjustable arm, mounted to the support, holds the nozzle. The arm is mounted to the support such that the arm can move with two degrees of freedom, relative to the support. Also, the arm is preferably of telescopic construction, providing a third degree of freedom. Thus, due to the flexible hose and the construction and mounting of the arm, the position of the nozzle can be continuously varied, with three degrees of freedom, and the nozzle can thus be positioned virtually anywhere, within the limits defined by the length of the arm and the height of the support.

The apparatus is operated by a process control unit, which contains known circuitry for determining the timing of the dispensing of liquid nitrogen. Such circuitry also receives an input from one or more sensors located at or near a carousel of containers, so that the dispensing of liquid nitrogen can be properly coordinated with the position of each container. In the preferred embodiment, a fluid conduit, connected between the vessel and the process control unit, conveys vaporized nitrogen into the process control unit. The nitrogen vapor so used tends to purge the interior of the process control unit, and keeps it dry, thereby reducing the likelihood of moisture-induced deterioration of the circuitry.

Excess vaporized nitrogen, beyond that which is needed to purge the process control unit, is conducted through a channel in the support, and vented to the outside environment. The channel can be an integral part of the support, or it can be formed separately from the support but mounted within and/or along the support.

The nozzle of the present invention preferably includes a control gas port and a purge gas port. These ports are connected, by conduits, to a vaporizer, which is in turn connected to a source of cryogenic liquid. The latter source may be the same source that supplies the vessel. The purpose of the vaporizer is to provide a gas which can be used to control the formation of droplets in the nozzle, and/or to de-ice the nozzle. The nozzle includes a narrow neck portion, into which unheated gas is injected, through the control gas port, at low pressure, to control the formation of droplets. If the nozzle becomes iced, the gas entering the control gas port can be heated and injected at high pressure. The nozzle also includes a shroud which is connected to the purge gas port. A small amount of heated gas, at low pressure, is injected through the purge gas port, to prevent formation of ice in the shroud. If the shroud area becomes seriously iced, heated gas at high pressure can be injected through this port.

One or more orifices in the nozzle can be detached from the assembly, simply by loosening a few screws. In particular, the size of the droplets can be changed by removing and replacing the lower orifice, i.e. the orifice closest to the outlet of the nozzle.

The present invention also comprises a method of injecting a cryogenic liquid, such as liquid nitrogen, into containers. The method comprises selecting a nozzle and/or orifice according to the containers into which the cryogenic liquid is to be injected, connecting the nozzle to a flexible hose, positioning the nozzle with a movable arm connected to a support, and controlling the delivery of cryogenic liquid to the nozzle. The method also includes tapping at least some of the vaporized cryogenic liquid for use in purging a housing for a process control unit, so as to keep the contents of that housing dry. The method also includes providing a gas, formed by vaporizing a cryogenic liquid, the gas being used for controlling the formation of droplets and for preventing ice formation or for removal of ice.

The present invention therefore has the primary object of providing an apparatus for injecting a cryogenic liquid into a container.

The invention has the further object of providing a cryogenic liquid injector which easily accommodates injector nozzles or nozzle orifices of varying sizes.

The invention has the further object of providing a cryogenic liquid injector, in which the position of a nozzle can be continuously varied and controlled.

The invention has the further object of providing a cryogenic liquid injector which is compact.

The invention has the further object of improving the efficiency of a cryogenic liquid injector.

The invention has the further object of prolonging the life of a process controller used in conjunction with a cryogenic liquid injector.

The invention has the further object of providing a method of injecting a cryogenic liquid into containers.

The invention has the further object of providing a method and apparatus for injecting heated gas into a nozzle so as to de-ice that nozzle, or to prevent the formation of ice.

The invention has the further object of providing a de-icing method and apparatus as described above, wherein a minimum amount of gas is used for de-icing, and wherein the de-icing nevertheless proceeds rapidly.

The invention has the further object of providing a method and apparatus for dispensing a cryogenic liquid, wherein energy losses are minimized.

The invention has the further object of reducing the risk of contamination of beverage containers due to ice falling into the containers before they are sealed.

The reader skilled in the art will recognize other objects and advantages of the present invention, from the following brief description of the drawings, the detailed description of the invention, and the appended claims.

DETAILED DESCRIPTION OF THE INVENTION

Figure 1:
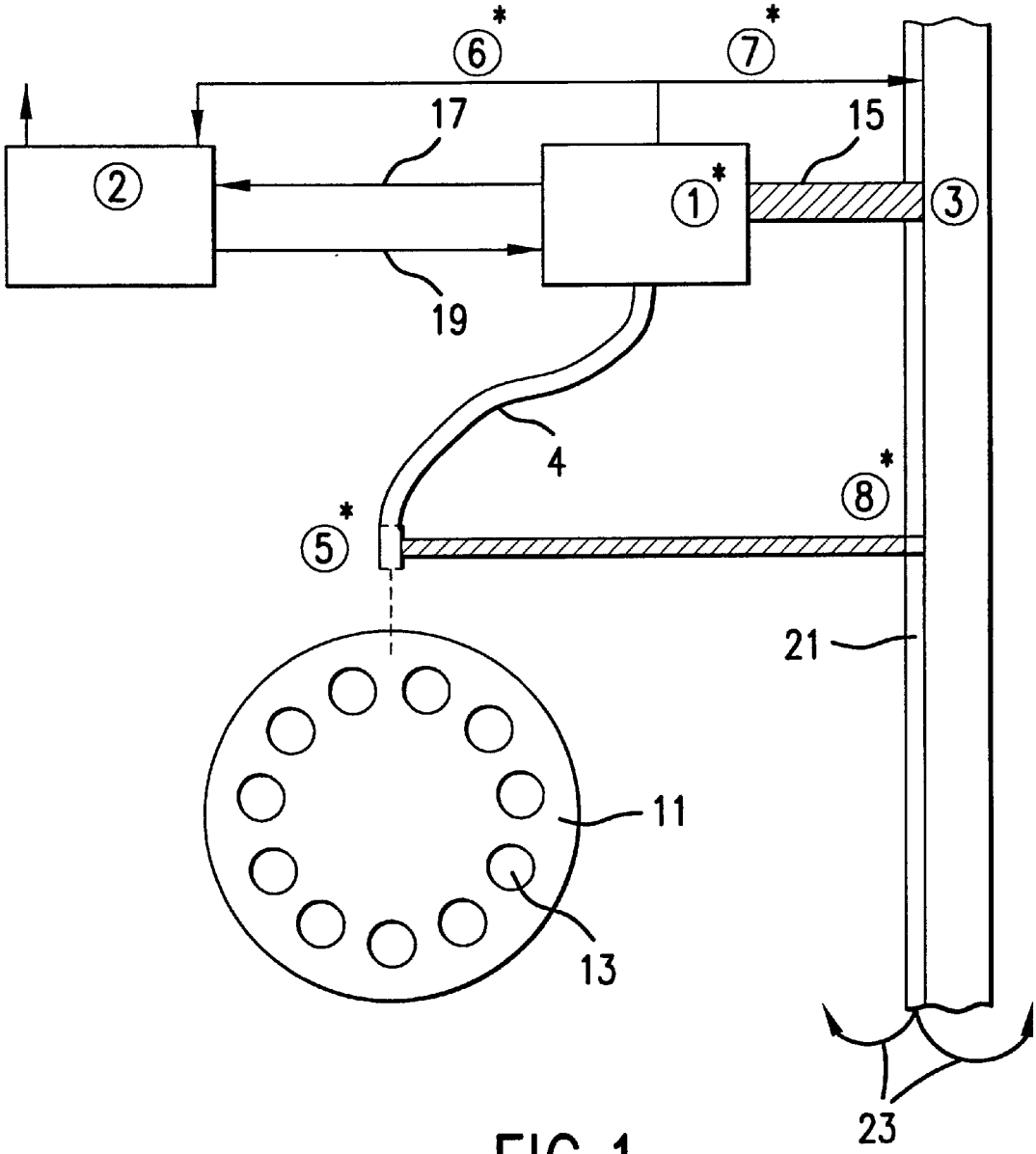
FIG. 1 provides a schematic and block diagram showing the cryogenic liquid injector of the present invention.

FIG. 1 provides a schematic and block diagram of the injector of the present invention. The cryogenic liquid, to be injected into containers, is stored in vessel 1. The vessel is connected to nozzle 5 by hose 4. The hose is flexible, and also is thermally-insulated. In the embodiment shown, vessel 1 is mounted above, and adjacent to, a carousel 11 which holds containers 13 to be filled. Because the vessel is positioned at a higher elevation than the containers, the cryogenic liquid can flow by gravity, and under the influence of a slight positive pressure, into the containers.

In the preferred embodiment, the vessel is thermally-insulated, such as with a vacuum jacket, and is chosen to have the minimum volume necessary to operate the injection process, so as to minimize the amount of cryogenic liquid that is vaporized due to heat losses during normal operation or while the unit is shut down.

The preferred cryogenic liquid is nitrogen, and much of the following description will refer to liquid nitrogen. However, other cryogenic liquids could be used instead, within the scope of the present invention, although the use of some substances could pose problems that must be addressed. For example, if the cryogenic liquid were oxygen, it would be necessary to take additional safety precautions that would not be necessary in the case of nitrogen. The invention is not intended to be limited to any particular cryogenic liquid.

Vessel 1 is mounted to support 3 by beam 15. Also, nozzle 5 is connected to the support by adjustable arm 8. The arm 8 is mounted to the support such that the arm can move up and down along the support, and also such that the arm can rotate about the support. Furthermore, the arm is preferably of telescopic construction, so that the length of the arm can be adjusted. Thus, the arm moves with two degrees of freedom relative to the support, and with an additional degree of freedom due to its telescopic construction. The arm therefore can move with three degrees of freedom, and can be adjusted to position the nozzle 5 in virtually any desired location, limited only by the height of the support and the maximum and minimum lengths of the arm.

In a preferred embodiment, the support may be about six feet tall. The invention is not limited, however, by any particular dimension of the components.

The process of injecting cryogenic liquid into containers is controlled by process controller 2. The process controller determines the exact moment at which cryogenic liquid is released from the vessel and directed into the containers. The process controller synchronizes the discharge of cryogenic liquid with the position of the carousel. This control may be accomplished by interrupting the flow of gas to a control port on the nozzle, as will be described below. Sensors (not shown) located at or near the carousel provide inputs to the controller, so that the desired synchronization can be accomplished. Lines 17 and 19 symbolize the exchange of signals between the process controller and the vessel, necessary to accomplish the desired control of the injection process. The circuitry of the process controller is commercially available, and does not itself form part of the present invention.

The process controller is located in a housing, both the housing and the process controller being symbolically represented by the box labeled by reference numeral 2. Conduit 6 provides a fluid path, from the head space above the cryogenic liquid in vessel 1, to the interior of the housing of the process controller 2. The head space in vessel 1 contains gas formed by vaporization of the cryogenic liquid stored therein. This gas, which is at a pressure somewhat greater than ambient, flows through conduit 6 and into the housing of the process controller. The housing of the process controller is essentially closed, though it is not completely airtight. The flow of gas into the housing tends to purge the interior of the housing, and keeps moisture out. Since the gas has a higher pressure than ambient, it also tends to prevent outside air from flowing into the housing. Indeed, it is the gas from conduit 6 which will tend to escape from the housing through gaps therein. By keeping the interior region of the housing slightly pressurized with vaporized cryogenic liquid, such as vaporized nitrogen, the contents of the housing are kept dry, thereby extending the life of the circuitry and instruments inside the housing.

As it turns out that not all of the head space gas is necessary for pressurizing and purging the interior of the housing of the process controller, the apparatus also includes conduit 7 which carries excess gas away. In the preferred embodiment, this excess gas is conveyed through a conduit 21 that is an integral part of support 3. Alternatively, the conduit can be separate from the support, and attached thereto. In either case, the gas is carried through conduit 21, and then vented to the outside, at or near the bottom of the support, as indicated by arrows 23.

The reason for using the conduit 21 is to provide time for the nitrogen (or other cold gas) to become heated to ambient temperature before being released into the environment. This arrangement avoids the formation of a cloud of gas near the top of the support, and also avoids the formation of ice in the support.

The flexible hose 4 makes it practical to install the system in a limited or cramped space. The vessel need not be positioned directly above the nozzle, but instead can be considerably offset from the nozzle, according to the space available, the two components being connected by the flexible hose. Also, because the ends of the hose are themselves flexible, one can insert the end of the hose over a variety of fittings, while still providing a snug fluid connection. Thus, with the present invention, one can use an injector nozzle or fitting having virtually any diameter, limited only by the elasticity of the end of the flexible hose.

Figure 2:
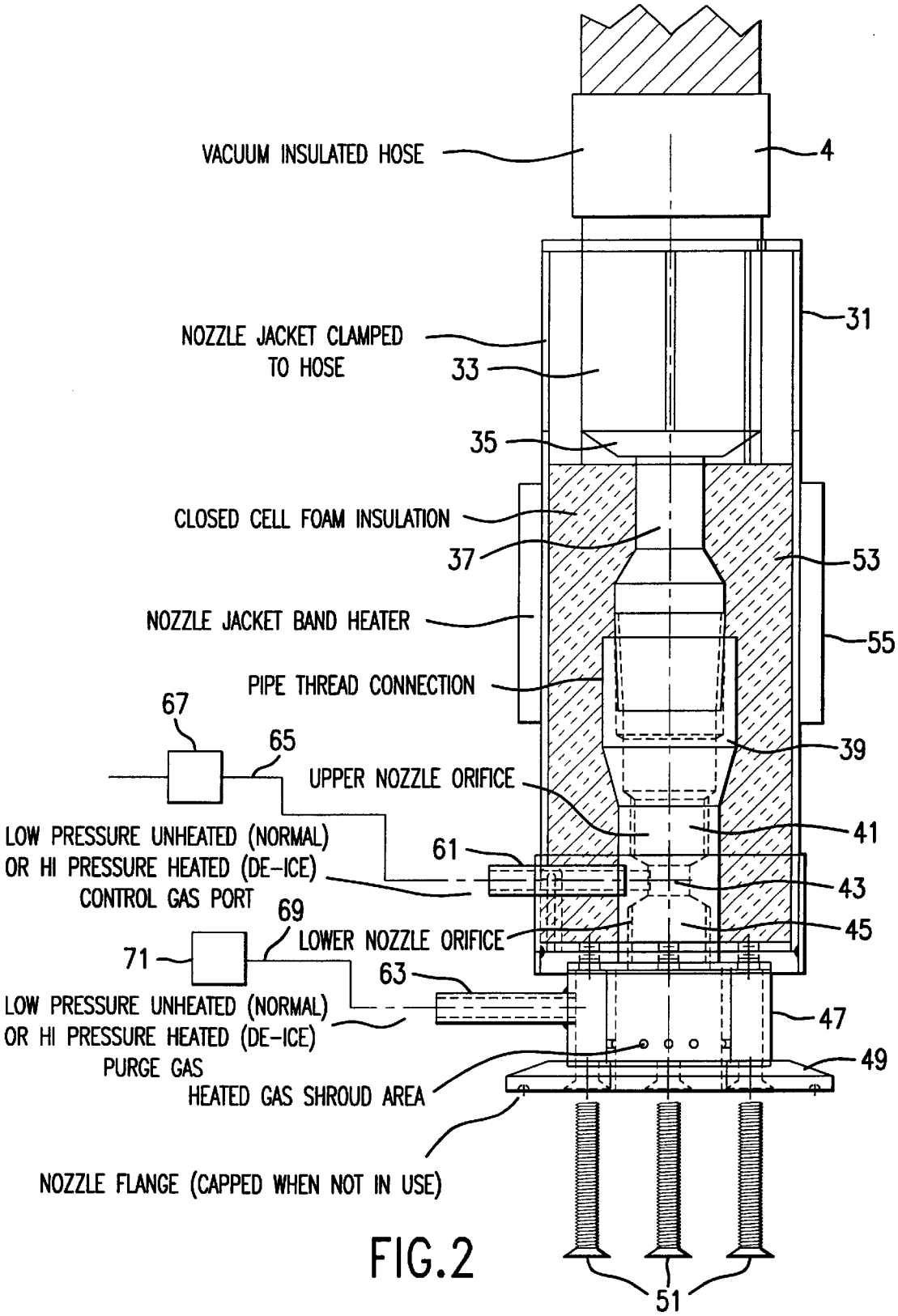
FIG. 2 provides a partially-schematic cross-sectional view showing the internal structure of the nozzle of the present invention.

FIG. 2 provides a cross-sectional view showing the details of the nozzle made according to the present invention. FIG. 2 shows a portion of vacuum-insulated flexible hose 4, which is the same hose shown in FIG. 1. The nozzle jacket 31 is clamped to the flexible hose. The nozzle includes an inlet chamber 33 which communicates with transition region 35, the transition region having the purpose of gradually reducing the diameter of the nozzle as shown, so that cryogenic liquid flows into pipe 37.

Pipe 37 is enveloped by shell 39, which may engage the pipe by a threaded connection, or by other means. Pipe 37 communicates with upper orifice 41, which has an outlet leading to a relatively narrow neck portion 43. The neck portion is connected to lower (outlet) orifice 45. The lower orifice has an outlet communicating with a region enclosed by shroud 47 which terminates with flange 49. The shroud and flange are shown partially disconnected from the main body of the nozzle, the shroud and flange being normally attached to the nozzle by screws 51.

The region between pipe 37 and the nozzle jacket 31 is filled with an insulating material, preferably a closed-cell foam 53. A portion of the nozzle jacket is surrounded by heater 55, which is preferably a resistance heater formed by a coil of wire encircling the nozzle jacket.

A control gas port 61 communicates with the narrow neck portion 43, and a purge gas port 63 communicates with the region within shroud 47. Both ports 61 and 63 are used to conduct gas, as will be described below.

Port 61 is connected to a source of cryogenic liquid by a conduit 65. The source is preferably the same as the source that supplies the vessel. Conduit 65 passes through heater 67, which may be another electric resistance heater, such as a coil of wire surrounding the conduit, or some other heating means. The conduit 65 and heater 67 are shown schematically in FIG. 2. The purpose of the heater is to vaporize the liquid and/or to raise the temperature of the gas in the conduit; by the time the gas enters port 61, it may have a temperature as high as about 160° F.

The gas entering port 61 can be used for either of two purposes. First, in normal operation, the gas can be used to control the formation of droplets. By injecting gas, at relatively low pressure, into neck portion 43, one interrupts the flow of cryogenic liquid, thereby dividing the stream of cryogenic liquid into droplets. The latter concept has been shown and described in U.S. Pat. No. 5,385,025, cited above. In this embodiment, the process controller regulates the flow of gas entering port 61, so as to synchronize the formation of droplets with the positions of the containers below. Secondly, one can inject heated gas at relatively high pressure, through port 61, so as to de-ice those parts of the nozzle which are nearest to this port.

In normal operation, that is, when the gas in conduit 65 is at low pressure, and used only to control the formation of droplets, the gas is not heated. In the de-icing mode, the gas is at high pressure, and is heated to provide the maximum de-icing effect. When the gas is at high pressure, it completely blocks the flow of cryogenic liquid; in this mode, production is suspended, and de-icing is the immediate goal.

The higher the temperature of the gas, the lesser the amount of gas needed for de-icing. For this reason, it is preferred to heat the gas to relatively high temperatures, such as 160° F. However, the gas may be heated to a lower temperature, in which case more gas will be needed.

By "low pressure" in this discussion, it is meant that the gas has a pressure of about 10–12 psig. By "high pressure", it is meant that the gas may have a pressure of about 50–70 psig. These numbers are exemplary, and are not intended to limit the scope of the invention.

Conduit 69, similar to conduit 65, is connected to purge gas port 63. Conduit 69 is connected to an external source of cryogenic liquid, which could be the same source that supplies conduit 65 and vessel 1. Conduit 69 also passes through heater 71, similar to heater 67. In normal operation, the gas in conduit 69 is heated and at low pressure, and is used to prevent ice formation in the area of the shroud. To remove ice which has already formed in the shroud, it is necessary to provide heated gas at high pressure.

Gas may be directed into ports 61 and 63 simultaneously. It is also possible to direct gas into control gas port 61 only, reserving purge gas port 63 for use only when necessary.

Heater 55 prevents the formation of ice on the outside of the nozzle jacket. While it is fundamentally important to prevent ice from blocking the flow of cryogenic liquid through the nozzle, it is also very important to prevent ice from forming even on the outside of the jacket, or almost anywhere else on the nozzle assembly. If ice breaks off and falls into the containers, the contents of the containers must be considered to be contaminated. To maintain uninterrupted production, it is thus important to keep all parts of the nozzle free of ice.

It is the lower orifice which determines the size of the droplets. To change the droplet size, one need only change the lower orifice. The lower orifice may be easily changed by removing the screws 51 and removing some of the components. It is usually not necessary to remove more than the lower orifice and the narrow neck portion 43. The latter procedure is a substantial improvement over the prior art, which required a complete removal and replacement of the nozzle to accomplish a similar objective.

Thus, the present invention makes it feasible to remove and replace a single orifice in the nozzle, or to remove and replace the entire nozzle assembly.

Figure 3:
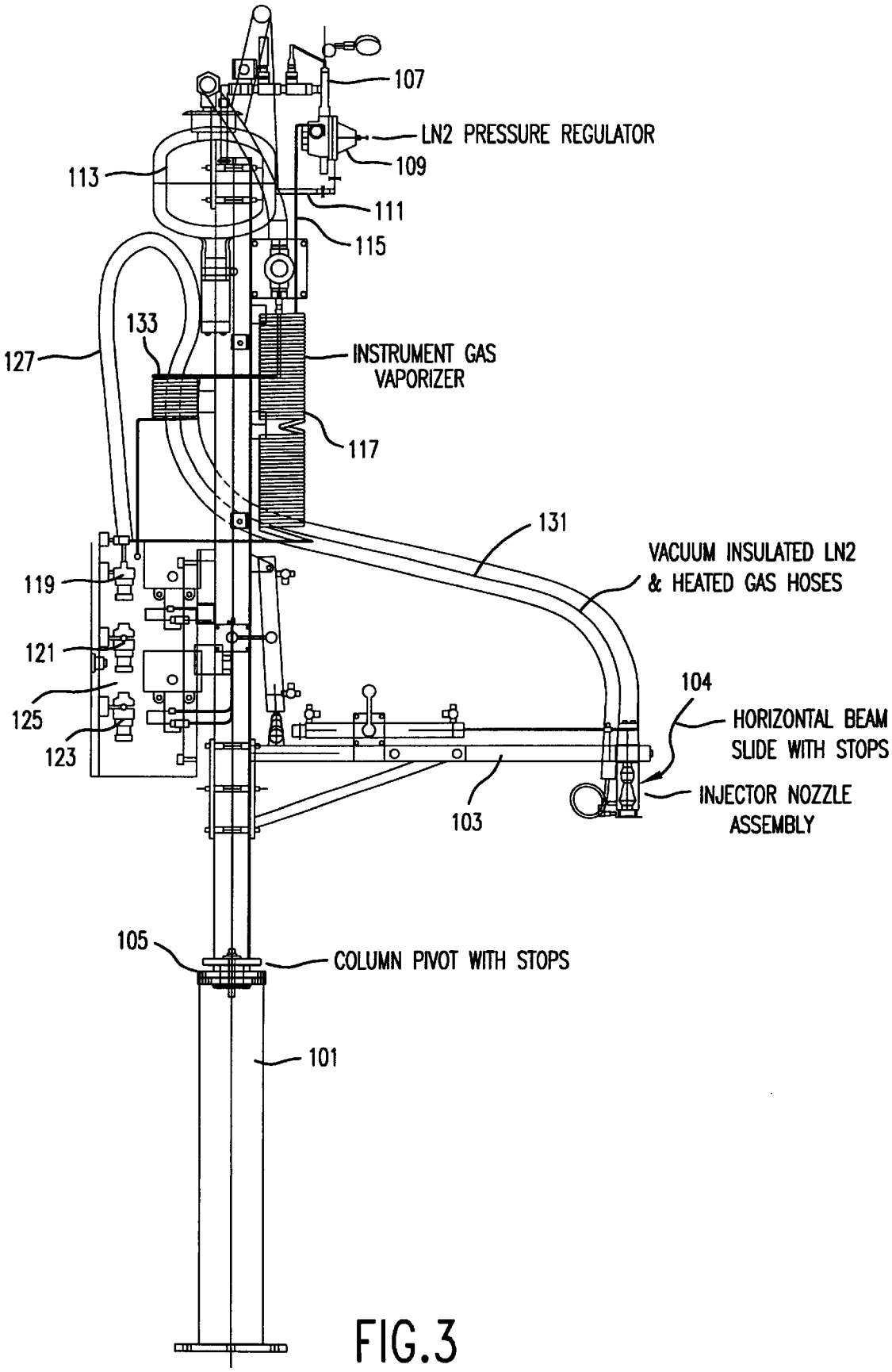
FIG. 3 provides a front elevational view of a preferred embodiment of the cryogenic liquid injector of the present invention.
Figure 4:
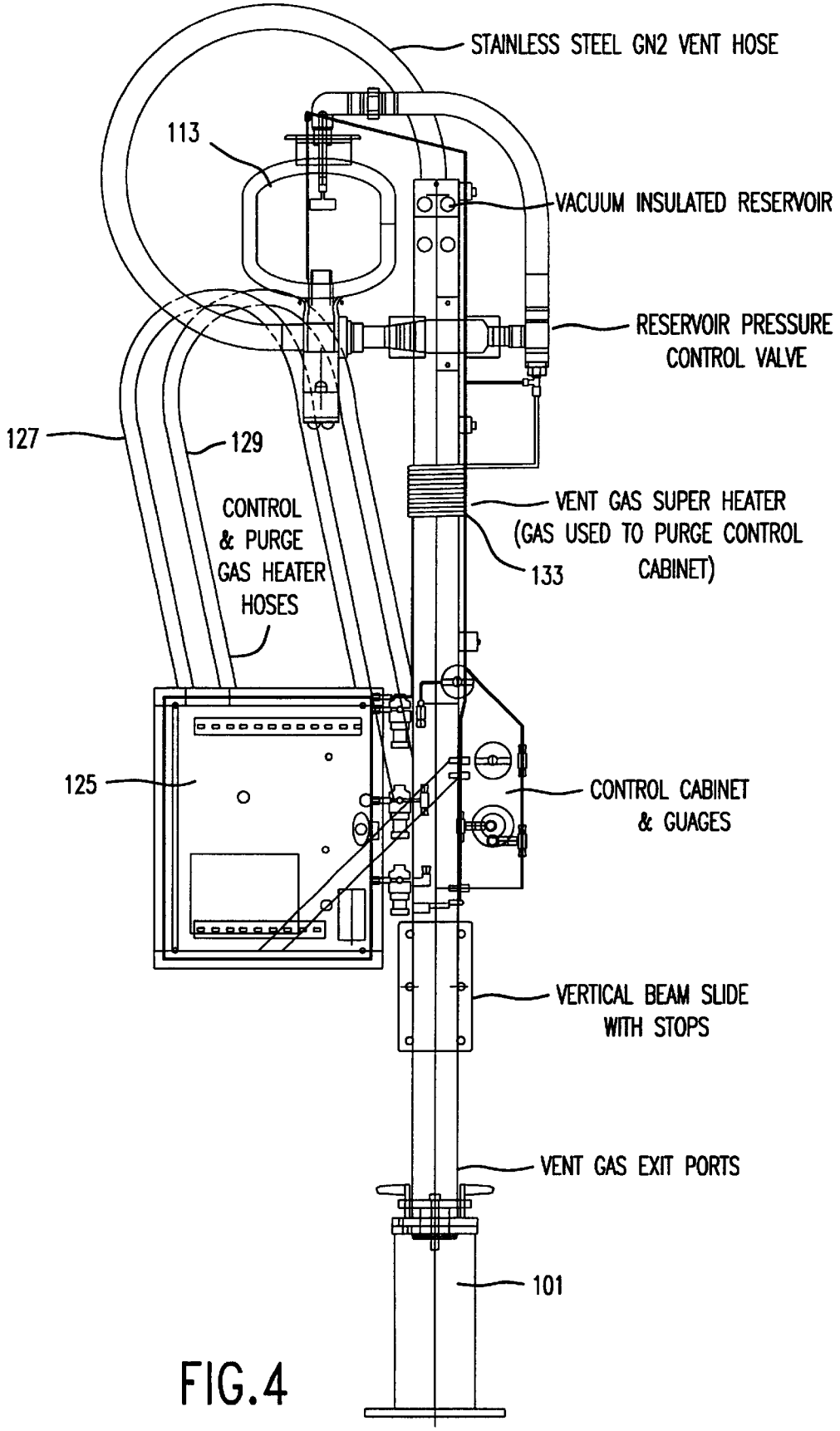
FIG. 4 provides a side elevational view of the injector shown in FIG. 3.

FIGS. 3 and 4 provide details of a specific preferred embodiment of the injector of the present invention. The apparatus is mounted on a support 101, which corresponds to support 3 of FIG. 1. An adjustable arm 103 (corresponding to arm 8 of FIG. 1) is connected to the support. The support is provided with a pivot joint 105, the joint having stops so that the upper portion of the support can be pivoted and then retained in a known position. The adjustable arm also has stops to prevent the arm from moving from its selected position.

Cryogenic liquid from an external source (not shown) enters the system at conduit 107, which is upstream of pressure regulator 109. The output 111 of the pressure regulator is a cryogenic liquid of reduced pressure, and is connected to vessel 113, which corresponds to vessel 1 of FIG. 1. Also, conduit 115 draws off cryogenic liquid, at high pressure, from the source, upstream of the pressure regulator. The cryogenic liquid carried by conduit 115 is used to form the control gas and purge gas, discussed above. Conduit 115 passes through vaporizer 117, which insures that the contents of the conduit become gaseous.

The gas carried by conduit 115 is delivered, in parallel, to each of pressure regulators 119, 121, and 123. Pressure regulators 119, 121, and 123 are mounted on the exterior of the housing of control unit 125 (corresponding to control unit 2 of FIG. 1). The latter pressure regulators are connected to gas lines, only one of which (identified by reference numeral 127) is visible in FIG. 3, and two being visible in FIG. 4 (identified by reference numerals 127 and 129). Appropriate solenoid valves in the control unit control the flow of gas in these lines. Pressure regulator 119 is associated with the purge line (corresponding to conduit 69 of FIG. 2). Pressure regulator 121 is associated with the control line (corresponding to conduit 65 of FIG. 2). Pressure regulator 123 is connected to a third line, not illustrated in FIG. 2, the third line providing pressure to power a pneumatic assist for moving the arm, and also serving as an auxiliary high pressure gas source in the event it is necessary to disable the other two lines.

Flexible hose 131 connects the vessel 113 with nozzle assembly 104. Hose 131 corresponds to hose 4 of FIG. 1.

Heater 133 heats the gas in the purge line, and corresponds to heater 71 of FIG. 2.

The apparatus of FIGS. 3 and 4 operates in the manner described above. The arrangement of components in the embodiment of FIGS. 3 and 4 should be considered exemplary and not limiting. Many other arrangements are possible, within the scope of the present invention.

The present invention substantially overcomes the limitations arising from the space available for the dispensing apparatus. With the present invention, one can install the system in a very limited space, due to the separation of the cryogenic liquid vessel from the nozzle which delivers the liquid droplets.

The present invention also includes the method of injecting the cryogenic liquid into the containers. In practicing this method, in its most basic form, one first connects a nozzle to one end of a flexible, thermally-insulated hose, and connects a second end of the hose to the vessel containing the cryogenic liquid. Next, one positions the nozzle such that the nozzle is disposed at a location which permits cryogenic liquid to flow out of the nozzle and into a container below. Finally, the flow of cryogenic liquid is controlled, preferably by automatic means, to enable measured small amounts of cryogenic liquid to flow from the vessel, through the nozzle, and into the container.

The method may also include the step of manipulating the arm supporting the nozzle, so that the nozzle is positioned at the desired location. This manipulating step, which can be performed manually, or which is preferably performed with a pneumatic power assist, may include raising or lowering the arm, relative to the support, rotating the arm about the support, and/or varying the effective length of the arm. The effective length of the arm can be varied by making the arm of telescopic construction.

The method of the present invention also includes the steps of conveying vaporized cryogenic liquid from the vessel to the process controller, so as to minimize the amount of moisture within the housing of the process controller. The method preferably also includes venting excess vaporized cryogenic liquid, by directing the excess vaporized liquid through a channel formed in the support, and then venting the vaporized liquid to the outside.

The method of the present invention also includes directing vaporized cryogenic liquid into ports on the nozzle, for the purposes of controlling the formation of droplets, and for preventing the formation of ice or for removing ice that has accumulated.

The present invention has many advantages over the prior art. With the present invention, it is not necessary to position the vessel directly above the carousel holding the containers. The flexible hose and the adjustable arm together allow the nozzle to be positioned virtually anywhere within the range of travel of the above components. Thus, for example, the present invention makes it feasible to arrange the vessel at a position offset from that of the carousel. This arrangement allows the system to work within the space limitations of a given installation, while taking full advantage of the space that is available. The apparatus of the present invention is also inherently compact.

The present invention is also inherently easy to handle, to install, and to service.

Because the present invention separates the nozzle from the vessel, through the use of the flexible hose, it therefore allows the use of a wide variety of nozzle sizes, without making any change whatever to the vessel. The invention therefore has more flexibility and versatility than any of the devices of the prior art, as it can be modified quickly and easily to suit the needs of a particular installation.

In addition to being usable within a limited space, the apparatus of the present invention is also usable in environments having high humidity. Due to the venting of excess gas through the conduit extending along the support, the apparatus is not likely to form ice in the vicinity of the vessel or elsewhere. Moreover, the construction of the nozzle prevents ice from clogging the path for fluid flow.

The invention can be modified in various ways which will become apparent to the reader skilled in the art. For example, the containers receiving the cryogenic liquid need not be mounted on a carousel, but could instead be mounted on some other type of holder. Various means of connecting the arm 8 to the support 3 can be used, within the scope of the present invention. Such modifications should be considered within the spirit and scope of the following claims.

What is claimed is:

1. An apparatus for injecting cryogenic liquid into containers, comprising:

a) a vessel for storing a cryogenic liquid, b) a flexible, thermally-insulated hose, the hose being connected to the vessel and to a nozzle, c) a support for holding the vessel at a desired vertical position, and d) an adjustable arm, the arm having a first end which is mounted to the support such that the arm is capable of movement relative to the support, the arm having a second end which is connected to the nozzle.

2. The apparatus of claim 1, further comprising a process control unit, and a conduit connected between the vessel and the process control unit, wherein the conduit comprises means for conveying vaporized cryogenic liquid from the vessel to the process control unit.

3. The apparatus of claim 2, further comprising a second conduit connected to the vessel, the second conduit comprising means for conveying excess gas away from the vessel.

4. The apparatus of claim 3, wherein the second conduit is connected to a channel disposed along the support.

5. The apparatus of claim 4, wherein the channel includes a vent located at a bottom portion of the support.

6. The apparatus of claim 1, wherein the arm can be moved, relative to the support, such that the nozzle can be moved with three degrees of freedom.

7. The apparatus of claim 1, wherein the nozzle includes a control gas port, wherein the control gas port is connected to a conduit containing vaporized cryogenic liquid for controlling formation of droplets passing through the nozzle.

8. The apparatus of claim 7, further comprising means for heating gas flowing to said control gas port.

9. The apparatus of claim 7, wherein the nozzle further comprises an outlet orifice and a shroud positioned adjacent to the outlet orifice, and wherein the nozzle includes a purge gas port, the purge gas port being connected to a conduit containing vaporized cryogenic liquid for purging an interior region of the shroud.

10. The apparatus of claim 9, wherein the outlet orifice is removable from the nozzle.

11. An apparatus for injecting cryogenic liquid into containers, comprising:

a) a vessel for storing a cryogenic liquid, b) a flexible, thermally-insulated hose, the hose having one end connected to the vessel and another end connected to a nozzle, c) a support for holding the vessel at a desired vertical position, d) an adjustable arm, the arm having a first end which is mounted to the support such that the arm is capable of movement relative to the support, the arm having a second end which is connected to the nozzle, e) a process control unit, connected to the vessel, for controlling dispensing of a cryogenic liquid from the vessel, and f) a fluid conduit connected between the vessel and the process control unit, wherein the conduit permits vaporized cryogenic liquid to flow from the vessel into the process control unit.

12. The apparatus of claim 11, wherein the support includes a channel, and wherein the apparatus includes a second fluid conduit connected between the vessel and the channel.

13. The apparatus of claim 12, wherein the channel includes a vent located at a bottom portion of the support.

14. The apparatus of claim 11, wherein the arm can be moved, relative to the support, such that the nozzle can be moved with three degrees of freedom.

15. The apparatus of claim 11, wherein the nozzle includes a control gas port, wherein the control gas port is connected to a conduit containing vaporized cryogenic liquid for controlling formation of droplets passing through the nozzle.

16. The apparatus of claim 15, further comprising means for heating gas flowing to said control gas port.

17. The apparatus of claim 15, wherein the nozzle further comprises an outlet orifice and a shroud positioned adjacent to the outlet orifice, and wherein the nozzle includes a purge gas port, the purge gas port being connected to a conduit containing vaporized cryogenic liquid for purging an interior region of the shroud.

18. An apparatus for injecting a cryogenic liquid into containers, comprising:

a) a holder having a plurality of containers supported thereon, b) a vessel for storing a cryogenic liquid, the vessel being positioned above the holder and being attached to a support, c) a flexible, thermally-insulated hose, the hose having one end connected to the vessel and another end connected to a nozzle, and d) an adjustable arm, the arm having a first end which is mounted to the support such that the arm is capable of movement relative to the support, the arm having a second end which is connected to the nozzle.

19. The apparatus of claim 18, further comprising a process control unit, connected to the vessel, for controlling dispensing of a cryogenic liquid from the vessel.

20. The apparatus of claim 19, further comprising a fluid conduit connected between the vessel and the process control unit, wherein the conduit permits vaporized cryogenic liquid to flow from the vessel into the process control unit.

21. The apparatus of claim 20, wherein the support includes a channel, and wherein the apparatus includes a second fluid conduit connected between the vessel and the channel.

22. The apparatus of claim 21, wherein the channel includes a vent located at a bottom portion of the support.

23. The apparatus of claim 18, wherein the arm can be moved, relative to the support, such that the nozzle can be moved with three degrees of freedom.

24. The apparatus of claim 18, wherein the nozzle includes a control gas port, wherein the control gas port is connected to a conduit containing vaporized cryogenic liquid for controlling formation of droplets passing through the nozzle.

25. The apparatus of claim 24, further comprising means for heating gas flowing to said control gas port.

26. The apparatus of claim 25, wherein the nozzle further comprises an outlet orifice and a shroud positioned adjacent to the outlet orifice, and wherein the nozzle includes a purge gas port, the purge gas port being connected to a conduit containing vaporized cryogenic liquid for purging an interior region of the shroud.

27. An apparatus for injecting cryogenic liquid into containers, comprising:

a) a vessel for storing a cryogenic liquid, b) a flexible, thermally-insulated hose, the hose having one end connected to the vessel and another end connected directly to a nozzle, the hose defining a valve-free connection between the vessel and the nozzle, and c) a support for holding the vessel at a desired vertical position, wherein the nozzle is movable with three degrees of freedom.

28. The apparatus of claim 27, further comprising an adjustable arm, the arm having a first end which is mounted to the support such that the arm is capable of movement relative to the support, the arm having a second end which is connected to the nozzle.

29. The apparatus of claim 27, further comprising a process control unit, and a conduit connected between the vessel and the process control unit, wherein the conduit comprises means for conveying vaporized cryogenic liquid from the vessel to the process control unit.

30. The apparatus of claim 29, further comprising a second conduit connected to the vessel, the second conduit comprising means for conveying excess gas away from the vessel.

31. The apparatus of claim 30, wherein the second conduit is connected to a channel disposed along the support.

32. The apparatus of claim 31, wherein the channel includes a vent located at a bottom portion of the support.

33. An apparatus for injecting cryogenic liquid into containers, comprising:

a) a vessel for storing a cryogenic liquid, b) a flexible, thermally-insulated hose, the hose having one end connected to the vessel and another end connected to a nozzle, and c) a support for holding the vessel at a desired vertical position, wherein the nozzle is movable with three degrees of freedom, wherein the nozzle includes a control gas port, wherein the control gas port is connected to a conduit containing vaporized cryogenic liquid for controlling formation of droplets passing through the nozzle, and wherein the apparatus further comprises means for heating gas flowing to said control gas port.

34. The apparatus of claim 33, further comprising means for heating an exterior region of the nozzle.

35. The apparatus of claim 33, wherein the nozzle includes an outlet orifice, wherein the outlet orifice is connected to a shroud, and wherein the nozzle further comprises a purge gas port communicating with the shroud, the purge gas port being connected to a conduit containing vaporized cryogenic liquid for purging an interior region of the shroud.

36. A method of injecting a cryogenic liquid into containers, comprising:

a) connecting a nozzle directly to a first end of a flexible, thermally-insulated hose, and connecting a second end of the hose to a vessel containing a cryogenic liquid, such that the hose defines a valve-free connection between the vessel and the nozzle, b) positioning the nozzle such that the nozzle is disposed at a position permitting injection of cryogenic liquid, from the vessel, into a container located below the nozzle, and c) controlling a flow of cryogenic liquid between the vessel and the nozzle.

37. The method of claim 36, wherein the nozzle is connected to an arm which is mounted to a support, and wherein the arm is capable of movement so as to allow the nozzle to move with three degrees of freedom, and where in the positioning step comprises adjusting said arm so as to position the nozzle at a desired location.

38. The method of claim 36, wherein the controlling step is performed by a process controller, the method further comprising conveying vaporized cryogenic liquid from the vessel to the process controller.

39. The method of claim 37, wherein the support includes a channel, and wherein the method further comprises venting excess vaporized cryogenic liquid from the vessel into said channel.

40. The method of claim 36, wherein the controlling step comprises directing vaporized cryogenic liquid to a control gas port on the nozzle, so as to interrupt a flow of cryogenic liquid through the nozzle.

41. The method of claim 40, further comprising the step of heating the vaporized cryogenic liquid so as to prevent ice formation in the nozzle.

42. The method of claim 40, wherein the nozzle also includes a shroud and a purge gas port connected to the shroud, and wherein the method further comprises conveying vaporized cryogenic liquid to the purge gas port, so as to prevent ice formation in a vicinity of the shroud.

43. The method of claim 42, further comprising the step of heating the vaporized cryogenic liquid flowing to said purge gas port.

44. An apparatus for injecting cryogenic liquid into containers, comprising:

a) a vessel for storing a cryogenic liquid, b) a flexible, thermally-insulated hose, the hose having one end connected to the vessel and another end connected to a nozzle, and c) a support for holding the vessel at a desired vertical position, wherein the nozzle is movable with three degrees of freedom, further comprising an adjustable arm, the arm having a first end which is mounted to the support such that the arm is capable of movement relative to the support, the arm having a second end which is connected to the nozzle.

45. An apparatus for injecting cryogenic liquid into containers, comprising:

a) a vessel for storing a cryogenic liquid, b) a flexible, thermally-insulated hose, the hose having one end connected to the vessel and another end connected to a nozzle, and c) a support for holding the vessel at a desired vertical position, wherein the nozzle is movable with three degrees of freedom, further comprising a process control unit, and a conduit connected between the vessel and the process control unit, wherein the conduit comprises means for conveying vaporized cryogenic liquid from the vessel to the process control unit.

46. The apparatus of claim 45, further comprising a second conduit connected to the vessel, the second conduit comprising means for conveying excess gas away from the vessel.

47. The apparatus of claim 46, wherein the second conduit is connected to a channel disposed along the support.

48. The apparatus of claim 47, wherein the channel includes a vent located at a bottom portion of the support.

49. A method of injecting a cryogenic liquid into containers, comprising:

a) connecting a nozzle to a first end of a flexible, thermally-insulated hose, and connecting a second end of the hose to a vessel containing a cryogenic liquid, b) positioning the nozzle such that the nozzle is disposed at a position permitting injection of cryogenic liquid, from the vessel, into a container located below the nozzle, and c) controlling a flow of cryogenic liquid between the vessel and the nozzle, wherein the nozzle is connected to an arm which is mounted to a support, and wherein the arm is capable of movement so as to allow the nozzle to move with three degrees of freedom, and wherein the positioning step comprises adjusting said arm so as to position the nozzle at a desired location.

50. The method of claim 49, wherein the support includes a channel, and wherein the method further comprises venting excess vaporized cryogenic liquid from the vessel into said channel.

51. A method of injecting a cryogenic liquid into containers, comprising:

a) connecting a nozzle to a first end of a flexible, thermally-insulated hose, and connecting a second end of the hose to a vessel containing a cryogenic liquid, b) positioning the nozzle such that the nozzle is disposed at a position permitting injection of cryogenic liquid, from the vessel, into a container located below the nozzle, and c) controlling a flow of cryogenic liquid between the vessel and the nozzle, wherein the controlling step is performed by a process controller, the method further comprising conveying vaporized cryogenic liquid from the vessel to the process controller.

52. A method of injecting a cryogenic liquid into containers, comprising:

a) connecting a nozzle to a first end of a flexible, thermally-insulated hose, and connecting a second end of the hose to a vessel containing a cryogenic liquid, b) positioning the nozzle such that the nozzle is disposed at a position permitting injection of cryogenic liquid, from the vessel, into a container located below the nozzle, and c) controlling a flow of cryogenic liquid between the vessel and the nozzle, wherein the controlling step comprises directing vaporized cryogenic liquid to a control gas port on the nozzle, so as to interrupt a flow of cryogenic liquid through the nozzle.

53. The method of claim 52, further comprising the step of heating the vaporized cryogenic liquid so as to prevent ice formation in the nozzle.

54. The method of claim 52, wherein the nozzle also includes a shroud and a purge gas port connected to the shroud, and wherein the method further comprises conveying vaporized cryogenic liquid to the purge gas port, so as to prevent ice formation in a vicinity of the shroud.

55. The method of claim 54, further comprising the step of heating the vaporized cryogenic liquid flowing to said purge gas port.

* * * * *